United States Patent [19]

Darjee

[11] Patent Number: 4,722,203

[45] Date of Patent: Feb. 2, 1988

[54] STITCH-BONDED FABRICS FOR REINFORCING COATED ABRASIVE BACKINGS

[75] Inventor: Dhiraj H. Darjee, Ballston Lake, N.Y.

[73] Assignee: Norton Company, Worcester, Mass.

[21] Appl. No.: 855,874

[22] Filed: Apr. 24, 1986

Related U.S. Application Data

[63] Continuation of Ser. No. 664,446, Oct. 23, 1984, abandoned, which is a continuation of Ser. No. 297,538, Aug. 31, 1981, abandoned.

[51] Int. Cl.[4] ..... D04B 7/16

[52] U.S. Cl. ..... 66/202; 66/190; 66/196

[58] Field of Search ..... 66/202, 190, 192, 193, 66/195, 196, 84 A, 85 A

[56] References Cited

U.S. PATENT DOCUMENTS

| | | | |
|---|---|---|---|
| 2,890,579 | 6/1959 | Mauersberger | 66/192 |
| 3,030,786 | 4/1962 | Mauersberger | 66/84 |
| 3,967,472 | 7/1976 | Wildeman | 66/85 A |
| 3,991,593 | 11/1976 | Bernert et al. | 66/85 A |
| 4,067,210 | 1/1978 | Arons et al. | 66/192 |
| 4,197,723 | 4/1980 | Chedy et al. | 66/192 |
| 4,229,953 | 10/1980 | Warsop | 66/193 |
| 4,249,981 | 2/1981 | Pelletier | 156/441 |

FOREIGN PATENT DOCUMENTS

| | | | |
|---|---|---|---|
| 45-33874 | 10/1970 | Japan | 66/85 A |
| 1410153 | 10/1975 | United Kingdom | 66/84 A |
| 1469914 | 4/1977 | United Kingdom . | |
| 2070077 | 2/1981 | United Kingdom | 66/85 A |

OTHER PUBLICATIONS

Bahlo, "New Fabrics Without Weaving (Am. Asso. for Textile Technology Inc. (paper presented) Modern Textile Magazine, Nov. 1965, pp. 51-54.

Krôma, R. Characteristics, Features nd Properties of Non Wovens, Sep. 1982, pp. 1, 131, 148, 153, 157-1959, 161, 162, 165, 166.

H. Tough Industrial Applications, Sep. 1977 62-68 Textile Asia #8.

F. Ko et al., Development of Multi-Bar Weft-Insert Warp Knit Glass Fabrics for Industrial Applications Journal of Engineering for Industry, Nov. 1980, pp. 333-341.

Przeglad Wlokienniczy #4, Stitch-Bonded Fabrics as Substitute for Industrial Fabrics, Textile Review, 221-223.

Modern Non-Wovens Technology Publ. Non-Wovens (Report (Texpress), 121-128, 199-208, 124-125.

Skopalik, Jr. "Arutex-Stitch-Bonding Combined with Weft Laying System", Textile Manufacaturer, vol. 98, No. 1162, Nov. 1971, pp. 18-22.

Zeisberg, "Sewing-Knitting Machines Malimo Technical Possibilities and Technology", Texima, Part 2, pp. 1-15.

W. Schach, Influences of Yarn Feeding on Stitch Formation on Knitting Machines with Regard to the Reciprocating Effect of Yarn Tension, Fabric Tension and the Movement of the Knitting Instruments, Aug. 1974 from Wirkerei-und Strickerei-Technik, 1968, 18, No. 6, 309-315.

*Primary Examiner*—Ronald Feldbaum

*Attorney, Agent, or Firm*—Eugene C. Rzucidlo; Frank S. Chow; Norvell E. Wisdom, Jr.

[57] ABSTRACT

Stitch bonded fabrics were found to be suitable substrates for coated abrasives when the fabric has a strength in the warp direction of at least 30 dekanewtons (daN) per centimeter (cm) of width, a fill yarn cover factor of at least 40%, and stitch yarns with a tensile strength of at least 0.5 daN. For substitution of the established commercial classes of abrasives known as X and Y weights, the fabrics are preferably made on a Malimo machine, with 14-22 warp yarns of 840-1300 denier high tenacity multifilament polyester or glass per 25 cm of fabric width, at least 64 fill yarns of staple or texturized multifilament polyester per 25 cm of fabric length, and stitch yarns of 70-140 denier high tenacity multifilament polyester.

14 Claims, 3 Drawing Figures

STITCH-BONDED FABRICS FOR REINFORCING COATED ABRASIVE BACKINGS

FIELD OF THE INVENTION

This is a continuation of application Ser. No. 664,446 filed Oct. 23, 1984, now abandoned, which is a continuation of Ser. No. 297,538 filed Aug. 31, 1981, now abandoned.

The present invention relates to stitch-bonded fabrics which are especially suitable for reinforcing the backings of coated abrasives in the manner described in copending application Ser. No. 280,040, which is assigned to the same assignee as this invention.

BACKGROUND OF THE INVENTION

Problems connected with the use of woven cloth as a backing for coated abrasive articles, and for belts in particular, are the elongation characteristic inherent in woven cloth, due to the repeated curvature in the yarns, inherently produced by the interlaced nature of the material, and a weakening of the material in certain circumstances due to the inherent presence of "knuckles" at the crossover points in the yarn. Knuckles are the small bumps on the surface of woven cloth caused by yarns curving to cross over other yarns. The presence of such knuckles is believed to be responsible for the catastrophic failure of coated abrasive article, particularly belts, in certain severe grinding operations.

Stitch-bonded fabrics in general have been known for at least the last twenty years. However, until the invention described in the above referenced copending application, it was not appreciated that such fabrics could confer special advantages when used as the reinforcing substrate for coated abrasive backings. Thus no fabrics explicitly suitable for such purposes were known to the applicant from prior art.

The desirable properties of woven textiles as a backing material for coated abrasives are retained, and many of the undesirable properties are avoided by the use of arrays of substantially coplanar and coparallel textile yarns. Ideal properties for coated abrasives would be expected for backings in which the arrays of yarns are exactly coplanar.

In order to produce stitch bonded fabric in large volume at low cost, it is necessary to use one of the special machines designed for such purposes. A wide variety of machines are available commercially, including those supplied under the trade name Malimo (short for MALIMO Type Malimo) by Unitechna Aushandelgesellschaft mbH of Karl Marx Stadt, GDR, those with the trade name Weft/Loc made by Liba Maschinenfabrik GmbH, D-8674 Naila, FRG, and Raschel knitting machines. (A list of suppliers of Raschel machines is given on pages 31–38 of Volume 43, No. 35 of Knitting Times, the official publication of the National Knitted Outerwear Assoc., 51 Madison Avenue, New York, N.Y., 10010.)

These commercially available machines are normally limited to a maximum number of about one warp yarn per millimeter (mm) of fabric width. This limitation is believed to be necessary to accommodate a sufficient number of stitch or loop forming devices in the machine to form bonds across the entire width of the fabric substantially simultaneously. Because conventional woven fabrics for coated abrasives mostly contain at least twice this many warp yarns, no simple adaptation of the woven fabric designs to the requirements of stitch bonding machines was feasible.

It should be noted that it is possible to feed more than one warp yarn through each of the machine openings for such yarns provided in many of these machines. However, any such multiplicity of yarns fed through one opening will be bonded by the machine as if it were a single yarn. Thus the practical effect achieved by a multiplicity of yarns fed through one opening is essentially the same as that from using one plied yarn with a number of plies equal to the multiplicity of single unplied yarns. In both woven and stitch bonded fabrics, the results achieved from use of such plied yarns are not generally as satisfactory for fabric cover and for the desirable combination of strength with flexibility as can be achieved with evenly spaced finer yarns which give the same total warp tensile strength.

As noted below, the preferred machines for the fabrics of the present invention are those of the Malimo type. A publication by the manufacturer of Malimo machines, "Sewing-Knitting Machines MALIMO Technical Possibilities and Technology" describes the general range of operating conditions possible for machines of this particular type. A copy of this publication is attached and is hereby incorporated herein by reference. As may be seen from FIG. 3 in Part III, Section 3.1 of this publication, the warp and fill yarns laid out by the machine are straight and not interlaced with each other. The description of mechanical characteristics of Malimo machines given immediately below condenses from this publication those characteristics believed by the applicant to be most relevant to design of fabrics suitable for use in coated abrasives. In this condensation, the term "weft" has been changed to "fill" in accordance with common United States practice, and the term "hook needle" has been shortened to "hook"; all other terms describing the mechanical parts of the machines have been taken directly from the referenced publication.

Malimo machines have three principal mechanical characteristics which limit the variety of fabric constructions available from them. The first of these limits is provided by a group of several matched mechanical structures which fix a maximum "gauge" or number of yarns per 25 mm of width for the warp yarn and stitching yarn assemblies which can be used with the machine. Twelve possible gauges from 3 to 22 are available from the manufacturer.

The second of the principal mechanical limitations of the Malimo machine is its stitch length. This can be adjusted in 20 steps within a range of 0.7 to 5 mm. It should be noted that this nominal "stitch length" is actually the projected length in the direction of the warp yarns. When a tricot style stitch is used, as was the case for the fabrics to be described here, the actual spatial orientation of the stitch is at a substantial angle to the warp yarns, and the actual length is correspondingly longer than the nominal length. In addition, because the stitch yarns form loops, the length of yarn consumed for each stitch is generally considerably longer than either the nominal or actual length. With the fabrics described below, stitch yarn length consumption was about four times warp yarn length consumption.

The third of the principal mechanical limitations of the machine is provided by the assemblies of hooks which hold the fill yarns in tension until they can be stitched to the warp. Hook units are available in linear densities from 8 to 48 hooks per 25 mm. Under the normal conditions of use as contemplated by the instructions furnished by the manufacturer, no more than one bend of fill yarns around each hook is accommodated during fabric assembly operations.

It should be noted that it is an inherent characteristic of Malimo machines to lay fill yarns in two distinct groups at symmetric small angles on opposite sides of an imaginary line perpendicular to the warp yarn array. All fill yarn counts in this description are to be understood as including both of these fill yarn groups in the count.

The above referenced and incorporated Malimo publication gives some specifics of the construction of several fabrics suitable for other uses than coated abrasives. This is the largest such description of specific stitch-bonded fabrics known to applicant.

SUMMARY OF THE INVENTION

By careful selection and combination of particular types and sizes of yarn, and by operating commercially available machines outside the scope of the operating instructions furnished by their suppliers, it has been found possible to manufacture economical and effective fabrics for a wide variety of coated abrasives. In general, a satisfactory fabric will result if the warp yarn array has a tensile strength of at least 30 dekanewtons per centimeter of fabric width, the fill yarn array has a cover factor as defined below of at least 40%, and the stitching yarns have a tensile breaking strength of at least 0.5 dekanewtons each. For most purposes, this result is preferably attained by the use of warp arrays with yarns of high denier, high tenacity synthetic multifilament or glass in a number of at least 12 yarns per 25 mm of fabric width, fill yarn arrays of smaller denier texturized multifilament or staple synthetic yarn in a number of at least 64 per 25 mm of fabric length, and by fine denier stitch yarns with a breaking strength of at least 0.007 dekanewtons per denier.

DETAILED DESCRIPTION OF THE DRAWINGS

Figure 1:
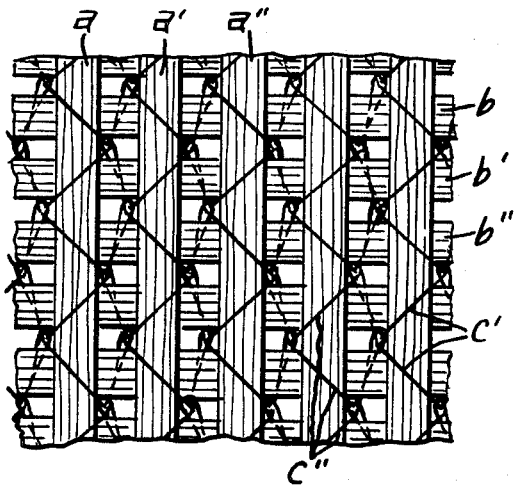
FIG. 1 is a magnified view, from the side on which warp yarns lie over the fill yarns, of the yarn configuration in a small area of one embodiment of this invention.

In FIG. 1, yarns a, a', and a'' are individual but identical warp yarns, which all lie over the fill yarn bundles b, b', and b''. As indicated by the term "bundles", these portions of the fill yarn array surrounded by a single stitch often contain more than one individual fill yarn. Within a small area such as is shown in the Figure, all the fill yarn bundles are substantially identical, but over a larger area it will be observed that occasionally one or more of the individual yarns in a bundle crosses into an adjacent bundle between two warp yarns. The individual but identical stitch yarns c' and c'' are prominent on this side of the fabric in a zig-zag pattern back and forth across the warp yarn with which they are associated.

Figure 2:
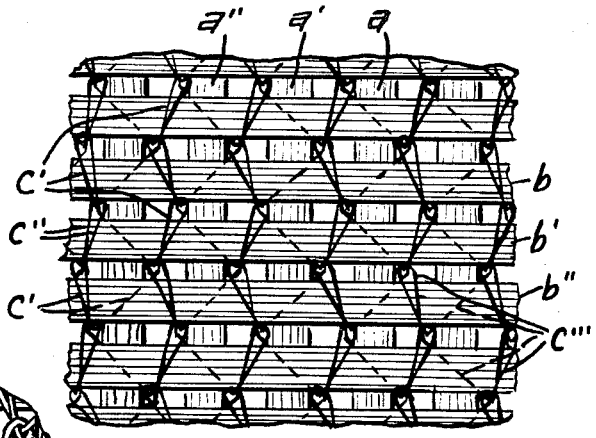
FIG. 2 shows the same fabric as FIG. 1 but from the opposite side, on which fill yarns lie over warp yarns.
Figure 3:
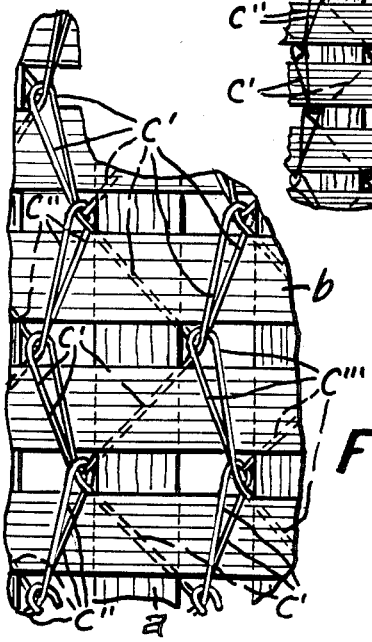
FIG. 3 is a magnified view of part of FIG. 2.

On the opposite side of the fabric as shown in FIG. 2, the loops of the stitching yarns are prominent as shown. The loops appear to form chains between the adjacent pairs of warp yarns, but in fact, as indicated on the drawing, only alternate loops of these apparent chains are really part of the same stitch yarn. FIG. 3 shows the tricot stitch pattern still more clearly. A single stitch yarn c' includes all the hidden zig-zag pattern under warp yarn a of this figure along with alternate loops of the two apparent chains of loops on each side of a. All the remaining stitch yarn portions shown in FIG. 3 belong to distinct but identical stitch yarns c'' on the left side of the figure or c''' on the right side.

DESCRIPTION OF THE PREFERRED EMBODIMENTS

Malimo machines with model numbers 14010 or 14011 were preferred for making the fabrics of the present invention. Liba machines and Raschel knitting machines make equally satisfactory fabrics but are limited to lower speeds of operation and thus are less economical.

It was considered desirable to provide reinforcing fabrics of my new type with tensile strengths at least equal to those of conventional coated abrasives with woven cloth substrates. Two of the most important classes of these conventional abrasives, commonly designated in the trade as X weight and Y weight, have tensile strengths of about 30 and 38 dekanewtons per centimeter (daN/cm) of width respectively. I have found that this level of tensile strength with stitch bonded fabrics can be achieved by using warp gauges from 12 to 22 with synthetic multifilament or glass yarns having breaking tenacities of at least 0.007 dekanewtons per denier. Using a coarser gauge can also achieve adequate tensile strength with high denier yarns.

Although high tenacity yarns are very effective in providing warp tensile strength, they provide relatively little cover or opportunity for facile mechanically aided adhesion of cloth finishing adhesives, which are needed to complete the final backings on which coated abrasives are to be made. I have found it possible to compensate for these deficiencies by using high linear densities of relatively small spun staple or textured multifilament fill yarns. The greater surface area per unit mass of these yarns, as compared with the warp yarns, provides superior possibilities for mechanical adhesion of the finishing adhesives and ready achievement of adequate cover, when combined with suitable processing techniques for the finishing.

An important feature of my invention, particularly useful for facilitating the achievement of adequate cover in the fabric, was may discovery that it was possible to produce fabrics having two or more fill yarns on each hook by operating outside the range of instructions furnished with the Malimo machine. If the machine gears were chosen so as to advance the fill yarn carrier, which is a mechanical part separate and distinct from the hook carriers, at half the minimum speed recommended by the manufacturer for the combination of hook spacing and number of fill yarns supplied, an average of two yarns would be retained by each hook. Alternatively, the speed of advance could be left the same, but the fill yarn carrier doubled in width. Similarly, advancing the carrier at one quarter of recommended speed or quadrupling its width would result in an average of four yarns retained per hook. Hooks 5 mm high were used for all constructions shown except those with 500 denier fill yarns; with these larger yarns the 7 mm size hooks gave better results. Medium size sliding needles and closing wires, 1.8 mm diameter stitching yarn guide holes, and round rather than oval retaining pins among the choices offered by the manufacturer were preferred for the fabrics shown. Both fill yarn carrier reeds and hook carriers with 32 openings per 25 mm were used for fabrics with 64 or 128 fill yarns per 25 mm, while carrier reeds and hook carriers with 24 openings per 25 mm were used for achieving 96 fill yarns per 25 mm.

Additional possibilities for adhesion and cover are provided by the stitch yarns. I have found synthetic multifilament yarns in deniers from 70 to 220 very satisfactory as stitch yarns for these fabrics. Aside from the resilience and flexibility needed in the stitch yarn to permit efficient operation of a stitch-bonding machine, the primary requisite from the stitch yarn for the ultimate coated abrasive is sufficient strength to resist rupture between the warp and fill arrays of yarns under use conditions. By experiment, 70 denier polyester yarn with a breaking strength of at least 0.008 daN per denier was found to be adequate for most purposes. For coated abrasives to be used under extremely damage prone conditions, however, it was advantageous to use 110, 140, or even 220 denier stitch yarns.

In general, shorter stitch lengths will give more uniform appearing fabrics, while longer stitch lengths will give more economy as a result of faster production speeds. For coated abrasive substrate fabrics, it has not been found advisable to use longer stitch lengths than 1.8 mm. The preferred range for most fabrics is 1.2 to 1.8 mm.

Each stitch normally forms a loop around only one warp yarn (unless more than one yarn is fed through a single opening as noted above), but the number of fill yarns inside a stitch loop can vary from none to several, depending on how many fill yarns happen to occupy the space inside the fixed stitch length. With long stitches and moderate fill yarn densities, a random pattern of short, relatively open spaces may often be observed in the fabric produced, as a result of greater or lesser than average number of fill yarns being caught inside the loops of particular stitches. Within the limits described herein, this pattern has not been found to cause any difficulty in the coated abrasives produced with such fabrics as substrates.

Some non-limiting examples of specific fabric designs satisfactory for coated abrasives are shown in Table 1. All these fabrics were made with hook carriers having no more than 32 hooks per 25 mm.

The cover factor for the fill yarn array noted in Table 1 is the same as the value often called "fractional coverage" by others; i.e., the fraction of the total area enclosed within the borders of a sample of the fabric which is covered by the film yarn array therein. In principle, this value could be easily calculated from a knowledge of the linear density and the diameter of the fill yarns: If n is the number of fill yarns per unit length of the fabric and d is the diameter of each yarn in the same units, the cover factor is 100nd%. In practice, measuring the diameter of yarn precisely is very difficult, and in conformance with common textile art practice, the cover factor used herein was determined by an indirect calculation making use of the density and denier size of the yarn. From the definition of denier (cf. footnote 1 in Table 1), it follows that the mass m in grams of a one centimeter length of yarn is equal to the densier (D) divided by $9\times10^5$. The volume v in cubic centimeters of the same length of yarn is approximated as that of a cylinder of the same diameter, so that $v=(\pi d^2)/4$. By definition, the density $p=m/v$. Combining and rearranging these expressions give % cover factor$=n(4D/90\ p\pi)^{\frac{1}{2}}$.

The density of a yarn in turn depends on the fundamental density of the fibers which compose it and on how tightly the fibers are packed. The latter characteristic of the yarn is quantified as a packing fraction,

TABLE 1

SOME SPECIFIC EXAMPLES OF STITCH BONDED FABRICS USEFUL FOR COATED ABRASIVE SUBSTRATES

| Fabric | Warp Array Characteristics | | | | Fill Array Characteristics | | | | | Stitch Characteristics | | |
|---|---|---|---|---|---|---|---|---|---|---|---|---|
| Identification Number | Yarn Fiber Type | Yarn Size[1] | Yarns per 25 mm | Tensile Strength, daN/cm of width | Yarn Fiber Type | Yarn Size[1] | Yarns per 25 mm | Tensile Strength, daN/cm of width | Cover Factor[2] | Yarn Fiber Type | Yarn Size[1] | Stitch Length, mm |
| 1 | Polyester[3] | 1000/192 | 14 | 44 | Polyester[4] | 170/33 | 64 | 15 | 40.7% | Polyester[5] | 70 | 1.2 |
| 2 | Polyester[3] | 1300/192 | 14 | 57 | Polyester[4] | 170/33 | 128 | 30 | 81.4% | Polyester[5] | 140 | 1.2 |
| 3 | Polyester[3] | 840/140 | 18 | 48 | Polyester[4] | 170/33 | 96 | 22 | 61.0% | Polyester[5] | 70 | 1.2 |
| 4 | Polyester[3] | 1300/192 | 14 | 57 | Polyester[6] | 443 | 96 | 48 | 98.0% | Polyester[7] | 150 | 1.2 |
| 5 | Polyester[3] | 1300/192 | 14 | 57 | Mixed[8] | 300 | 96 | 53 | 81.0% | Polyester[5] | 220 | 1.2 |
| 6 | Polyvinyl Alcohol[9] | 1000/200 | 14 | 44 | Polyester[7] | 150/34 | 128 | 26 | 77.0% | Polyester[5] | 110 | 1.2 |
| 7 | Polyvinyl Alcohol[10] | 1200/200 | 14 | 62 | Polyester[6] | 443 | 96 | 48 | 98.0% | Polyester[5] | 140 | 1.4 |
| 8 | ECG-37 Glass[11] | 1207 | 14 | 30 | Polyester[4] | 170/33 | 128 | 30 | 81.4% | Polyester[5] | 70 | 1.2 |
| 9 | ECG-37 Glass[11] | 1207 | 14 | 30 | Polyamide[12] | 500 | 64 | 53 | 70.0% | Polyester[5] | 220 | 1.2 |
| 10 | ECH-25 Glass[11] | 1786 | 14 | 48 | Mixed[8] | 300 | 96 | 53 | 81.0% | Polyester[5] | 220 | 1.8 |
| 11 | Polyester[3] | 1300/192 | 14 | 57 | Polyamide[12] | 500 | 64 | 53 | 70.0% | Polyester[5] | 220 | 1.2 |

[1]The first number under this column gives the yarn size in denier, which is the mass in grams of 9000 meters of the yarn. The number after the virgule (/), if any, gives the number of monofilaments in each yarn as specified by the manufacturer.
[2]Cf. the specification for the method of calculating cover factor.
[3]Type 68 Dacron from duPont was used.
[4]Type 731 Texturized Fortrel from Celanese was used.
[5]Type 68 Dacron high tenacity yarn from duPont was used.
[6]Spun staple polyester, either duPont Type 54W or Celanese Type 310 was used.
[7]Type 56T Dacron texturized yarn from duPont was used.
[8]A special yarn with a core of Dacron Type 68L and an outer surface of spun cotton was used. About 30% of the total yarn weight was cotton.
[9]Type 1225-7 Kuralon from Kuraray Co., Ltd. (Japan) is used.
[10]Type 1239 Kuralon from Kuraray Co. Ltd. (Japan) is used.
[11]Yarn used was purchased from PPG Industries, Inc.
[12]Type 439 Cordura Nylon from duPont was used.

which when multiplied by the fiber density gives the yarn density. The following values in gm/cm$^3$ for fiber density of the fill yarn fibers listed in Table 1 were taken: polyester, 1.3; cotton, 1.56; and polyamide, 1.14. Packing fractions taken were: textured polyamide, 0.80; textured polyester, 0.70; staple polyester, 0.59; and mixed yarn, 1.0.

It should be carefully noted that the calculations for cover factor noted above assume that the fill yarns are in position as laid out before stitching. Small variations from this value are expected after the fabric is stitched together. No attempt was made to calculate these latter variations, because they did not appear to affect the performance of coated abrasives made with the fabrics herein described as backing substrates. However, fabrics with fill cover factors of less than 40% as calculated above could not easily be finished suitably for receiving making adhesive and grain coats in the process of making a coated abrasive with a conventionally continuous backing.

USE OF THE INVENTION

The fabrics specified in Table 1, or other fabrics constructed using the same principles, may be finished in a variety of ways to make suitable backings for coated abrasives. These backings in turn may be coated with any of the variety of maker adhesives, abrasive grits, and sizer adhesives, well known in the art. Some specific examples of these ways to use my invention are given below, and others will be readily apparent to those skilled in the art of manufacturing coated abrasives, upon considering the teachings herein in combination with those of the aforesaid copending application.

EXAMPLE 1

Fabric of the construction with identification number 1 in Table 1 was used. This fabric was then saturated with a resin and acrylic latex composition to prepare it for frontfilling, backfilling, and coating with maker grain and size coat. A heat setting step is combined with the drying of the saturant. The fabric finishing steps will now be described in more detail.

Saturation and Heat Setting

Standard sizing rolls are employed to apply the following composition in the amount of 40 to 60 grams per square meter. The fill yarn side of the fabric was facing up.

Saturation Composition

Cymel 482, available from American Cyanamid, a melamine-formaldehyde resin syrup, 80% solids, pH 8 to 9: 160 parts Beetle 7238, available from American Cyanamid, a urea formaldhyde resin syrup, 65% solids: 124 parts water: 120 parts Aqueous solution containing 15%

$NH_4Cl$ and 24% 2-amino-2-methyl-propanol: 13 parts 5 to 7 parts pigment dispersions may be added to color backing Upon completion of the application of the saturant the fabric is dried on a tenter frame for at least 3 minutes in a hot air oven in which the temperature in the entry zone is 96° C., and the temperature at the exit zone is 177° C. A tension of at least 3.5 Newtons per centimeter (N/cm) of width is maintained on the fabric during its travel through the oven. This process not only dries the saturant but also heat-sets the fabric.

Frontfill Coating

The composition of the frontfill coating, applied to the fill yarn side in this example, but which can instead be applied to the warp yarn side if desired, is as follows:

(1) phenol-formaldehyde A stage resol resin syrup having a formaldehyde to phenol ratio of 1.5 and a solids content of 78%: 199 parts (2) $CaCO_3$: 160 parts (3) sodium lauryl sulfate: 2 parts (4) Hycar 2600×138, a latex of an acrylic acid ester polymer having a glass transition temperature of 25° C. available from B. F. Goodrich Chemical Company: 54 parts The frontfill coating composition is applied with a knife in the amount of 150–165 dry grams per square meter (gm/m$^2$), and water may be added as necessary to maintain the required viscosity for proper coating. The coating cloth is again dried on a tenter frame with a tension of at least 3.5N/cm of width by passing through a hot air oven in which the entry temperature is 96° C. and the exit zone temperature is 150° C.

Backfill Coating

To the side not coated with the frontfill is applied a backfill of the following composition:

(1) Beetle 7238 urea formaldehyde resin syrup available from American Cyanamid: 133 parts (2) Nopco NXZ anti-foam agent, available from Nopco Chemical Co., Newark, N.J.: 5.3 parts (3) UCAR 131 adhesive, a polyethylene-polyvinyl acetate 60% aqueous dispersion, available from Union Carbide Corporation, having a pH of 4 to 6: 133 parts (4) air washed clay: 176 parts (5) aqueous solution containing 15% $NH_4Cl$ and 24% 2-amino-2-methyl-propanol: 5.3 parts (6) water—to adjust viscosity to 11,000 cps at room temperature, as needed (pigment may be added if desired to color backing).

The composition is applied by knife coating in the amount of 140–165 gm/m$^2$ and dried in an oven having an entry zone temperature of 66° C. and an exit zone of 93° C.

The thus coated fabric is now ready for application of a maker coat of phenolic resin, the application of abrasive, and the application of an abrasive size coat, as is conventional and well known in the art. A suitable formulation to be applied to the frontsized side of the backing is as follows:

(1) phenol-formaldehyde alkaline catalyzed resol resin, F/P factor 2.08, pH 8.7, solids 78% in water: 7 parts (2) phenol-formaldehyde alkaline catalyzed resol resin, F/P 0.94, pH 8.1, solids in $H_2O$ 78%: 3 parts (3) $CaCO_3$: 1.54×total solids To the adhesively coated fabric is then applied by conventional electrostatic means 520–550 gm/m$^2$ of grit 60 high purity aluminum oxide abrasive grain. The abrasive-adhesive coated backing member is then heated for 25 minutes at 77° C., 25 minutes at 88° C., and 47 minutes at 107° C. to provide a dry adhesive layer (about 260 gm/m$^2$) and to anchor the abrasive grains in the desired orientation.

Afterwards, a size coat (about 160 gm/m$^2$ dry) of the same composition as the maker coat, except of lesser viscosity, is then applied according to usual techniques. The wet adhesive layer is then dried: 25 minutes at 52°

C., 25 minutes at 57° C., 18 minutes at 82° C., 25 minutes at 88° C., and 15 minutes at 107° C., after which final cure at 110° C. for 8 hours is given. The coated abrasive material is then ready to be converted according to usual techniques, into belts, discs, and other desired abrasive products.

While the above example described finishing the backing with the abrasive coat on the fill side of the cloth, in other cases it may be more desirable to coat on the warp side.

EXAMPLE 2

Cloth of the construction described with the identifying number 3 in Table 1 was coated by the dip and squeeze method with a two roll padder, using the following saturant:

Saturation Formula

1. Water (tap): 183.3 parts
2. Sodium Hydroxice (NaOH-solid flakes): 2.2 parts
3. Resorcinol: 13.5 parts
4. Formaldehyde, 37% aqueous solution: 14.2 parts
5. Hycar 2600×138: 81.3 parts
6. 2% by weight NaOH in water: As needed (Antifoam agent, if needed)

Mixing Instructions

Dissolve item 2 in item 1 with stirring, then add item 3 and stir until dissolved. Add item 4 and stir for 5 minutes; weigh out item 5 into separate container and add item 6 while stirring to adjust pH to near that of the RF premix (about 9) then add premix into item 5 with gentle stirring. If foam develops during addition, add small portions of an antifoam agent. (Falcoban S, made by Fallek Chemical Corp., 460 Park Ave., New York, NY 10022, was suitable, but many others should work equally well. If foam develops during coating, additional antifoam may be added.) This mixture should be stirred for at least 15 minutes after the last addition and held for 24 hours before use.

After coating, the fabric was held in a tenter frame to prevent width shrinkage and dried by passing for 3.75 minutes through an oven with an entry zone temperature of 135° C. and an exit zone temperature of 240° C. Sufficient saturant to give a dry add-on of 52±7 gm/m$^2$ was used.

After saturation and drying as described above, the fabric was backfilled, on the side where warp yarns are most prominently exposed, with the adhesive mixture noted below:

Resole phenol-formaldehyde resin with formaldehyde to phenol molar ratio of about 2.1–394 parts; Resole phenolic resin with F:P molar ratio about 0.95–282 parts; calcium carbonte (sized as described in U.S. Pat. No. 2,322,156)—850 parts; Hycar 2600X138 acrylic latex (previously adjusted to a pH value of 8–9 with 10% aqueous sodium hydroxide solution)—102 parts.

In preparing this solution, the ingredients are added in the order listed, with continuous stirring. The adhesive is coated on the saturated fabric by a knife over roll technique in sufficient quantity to give 175–225 gm/m$^2$ of adhesive after drying. For drying, the coated fabric is again tentered to eliminate any possible loss in width and is passed for 3.75 minutes through an oven with an entry zone temperature of 65° C. and an exit zone temperature of 107° C.

The backfilled fabric was then frontfilled on the opposite side from backfilling with the same adhesive composition as used for backfilling, in sufficient quantity to give 120–180 gm/m$^2$ of dried frontfill. Coating of frontfill could be accomplished either by knife or roll techniques with approximately equal facility. Oven conditions for drying frontfill were the same as for backfill, but satisfactory results in drying at this stage could be achieved without tentering if desired.

If any undesirable surface roughness was apparent on the finished fabric after completion of the steps above, it was calendered at a pressure of about 350 daN/cm of width, using conventional calender rolls heated to a temperature of 63° C.

The finished backing was then ready for making and sizing steps to convert it to a coated abrasive by conventional means as described briefly in Example 1.

EXAMPLE 3

Fabric number 8 from Table 1 was used for this example.

All other steps were the same as for Example 2.

Table 2 shows physical properties of the coated abrasives prepared in Examples 1–3 and compares them against the same measurements on commercial coated abrasive products with woven cloth backings. The tensile strength of the products described herein is closely comparable to the commercial products for Example 1 and superior for Examples 2 and 3. The burst strength, which is generally correlated with resistance to many environmental hazards during use of coated abrasives, is quite notably superior for Example 2 and closely comparable for the others. Elongation is higher for Examples 1 and 2 but lower or comparable for Fabric 3. Excessive elongation, specifically beyond the capacity for adjustment of the particular machine utilizing a coated

TABLE 2

COMPARISON OF PHYSICAL PROPERTIES OF COATED ABRASIVES

| Coated Abrasive Identification | Tensile Strength[1] (daN/cm) in Direction of: | | Percent Elongation[1] at Tensile Force Shown (in daN/cm) in Direction of: | | | | | Product Burst Strength[2], daN |
|---|---|---|---|---|---|---|---|---|
| | | | Warp | | | | Fill | |
| | Warp | Fill | 18 | 26 | 35 | Break | Break | |
| R 267, Grit 60[3] | 49 | 15 | 1.2 | 2.5 | 4.3 | 7.5 | 15.0 | 116 |
| Example 1 | 47 | 14 | 3.3 | 6.6 | 9.2 | 13.5 | 17.6 | 120 |
| Example 2 | 57 | 31 | 2.0 | 5.0 | 7.4 | 14.0 | 15.1 | 288 |
| Example 3 | 59 | 16 | 0.8 | 1.2 | 1.7 | 3.3 | 6.5 | 113 |
| R 811, | 44 | 13 | 0.9 | 1.7 | 3.0 | 5.0 | 18.8 | 116 |

TABLE 2-continued

COMPARISON OF PHYSICAL PROPERTIES OF COATED ABRASIVES

| Coated Abrasive Identification | Tensile Strength[1] (daN/cm) in Direction of: Warp | Fill | Percent Elongation[1] at Tensile Force Shown (in daN/cm) in Direction of: Warp 18 | 26 | 35 | Break | Fill Break | Product Burst Strength[2], daN |
|---|---|---|---|---|---|---|---|---|
| Grit 60[3] | | | | | | | | |

[1]This measurement was carried out in accordance with ASTM D1682-64, except that the sample length was 25.4 cm rather than 7.6 cm and a fixed elongation speed of 12.7 cm/min was used irrespective of time to break.
[2]This value was measured with a Mullen Burst Tester, sold by Roehlen Industries, Chicopee, Massachusetts, USA.
[3]Commercially available Y weight coated abrasives, sold by Norton Company, Worcester, Massachusetts.

abrasive belt, is undesirable, but otherwise elongation is not known to have any significant effect on the grinding performance. Thus very stretch-resistant warp yarns such as the glass of Example 3 can be used when needed, and the greater general toughness of a more easily stretched warp yarn type such as polyester can be advantageously used when the highest possible stretch resistance is not needed.

The adequacy of performance of the coated abrasives made by Examples 1-3 has been confirmed by actual grinding tests in both laboratory and field use.

It should be noted that by the term "yarn" used herein in the description and claims, I intend to include any continuous linear structures of any type of fiber twisted or laid together, whether made of natural or synthetic fibers, including a single monofilament. However, I do not consider unconsolidated short fibers to qualify as yarn for the purposes of my invention. Thus the fibers in mats for fleeces are not considered yarns by my definition. In particular, for "fill yarns" it is necessary for the structure so-called to be able to sustain tensile forces across the entire width of a fabric. Both fill and warp yarns, although possibly composed of twisted (and thus consolidated) short fibers, will normally be continuous for dimensions many times longer than the width of a fabric, often for hundreds of meters or more. Such continuity may of course be achieved by knotting or otherwise joining previously separate structures during the course of manufacturing a fabric.

I claim:

1. A reinforcing substrate for coated abrasive backings comprising a stitch bonded fabric, wherein said fabric comprises:

(a) an array of straight warp yarns having an array tensile strength of at least 30 dekanewtons per centimeter of fabric width;

(b) an array of straight fill yarns disposed on one side of said array of warp yarns and having a cover factor of at least 40%; and (c) a plurality of stitch yarns, each such yarn having a tensile breaking strength of at least 0.5 dekanewtons, formed in loops around groupsof individual yarn members of said arrays of straight warp yarns and of straight fill yarns, whereby the two said arrays of yarns are bonded into a coherent fabric.

2. A fabric according to claim 1, wherein the number of stitch yarns is at least as great as the number of warp yarns.

3. A fabric according to claim 2, wherein said array of straight warp yarns consists of substantially uniformly spaced yarns in a number not greater than one per millimeter of width of said array.

4. A fabric according to claim 3, wherein said array of straight fill yarns comprises more than 25 yarns per centimeter of fabric length.

5. A fabric according to claim 2, wherein said array of straight fill yarns comprises more than 25 yarns per centimeter of fabric length.

6. A fabric according to claim 1, wherein said array of straight fill yarns comprises more than 25 yarns per centimeter of fabric length.

7. A fabric according to claim 6, wherein at least half the volume of said stitch yarns consists of fibers having a tensile breaking strength of at least 0.007 dekanewtons per denier.

8. A fabric according to claim 5, wherein at least half the volume of said stitch yarns consists of fibers having a tensile breaking strength of at least 0.007 dekanenewtons per denier.

9. A fabric according to claim 4, wherein at least half the volume of said stitch yarns consists of fibers having a tensile breaking strength of at least 0.007 dekanewtons per denier.

10. A fabric according to claim 3, wherein at least half the volume of said stitch yarns consists of fibers having a tensile breaking strength of at least 0.007 dekanewtons per denier.

11. A fabric according to claim 2, wherein at least half the volume of said stitch yarns consists of fibers having a tensile breaking strength of at least 0.007 dekanewtons per denier.

12. A fabric according to claim 1, wherein at least half the volume of said stitch yarns consists of fibers having a tensile breaking strength of at least 0.007 dekanewtons per denier.

13. A fabric according to claim 4, wherein said array of straight fill yarns comprises to the extent of at least half its volume yarns of texturized filament polyester.

14. A fabric according to claim 13, wherein at least half the volume of the yarns of said array of straight warp yarns consists of multifilament polyester yarns having a breaking strength of at least 8 grams per denier.

* * * * *